US008246333B2

(12) United States Patent
Ju et al.

(10) Patent No.: US 8,246,333 B2
(45) Date of Patent: Aug. 21, 2012

(54) ROTOR PROFILE FOR A SCREW COMPRESSOR

(75) Inventors: Man Sig Ju, Seoul (KR); Jae Jung Bae, Gyeonggi-do (KR)

(73) Assignee: Kyungwon Machinery Co., Ltd., Siheung-si (KR)

( * ) Notice: Subject to any disclaimer, the term of this patent is extended or adjusted under 35 U.S.C. 154(b) by 929 days.

(21) Appl. No.: 12/328,295

(22) Filed: Dec. 4, 2008

(65) Prior Publication Data

US 2010/0086428 A1 Apr. 8, 2010

(30) Foreign Application Priority Data

Oct. 6, 2008 (KR) ..... 10-2008-0097633

(51) Int. Cl.

| | |
|---|---|
| ***F01C 1/14*** | (2006.01) |
| ***F01C 1/20*** | (2006.01) |
| ***F01C 1/24*** | (2006.01) |
| ***F04C 2/14*** | (2006.01) |
| ***F04C 2/20*** | (2006.01) |
| ***F04C 2/24*** | (2006.01) |

(52) U.S. Cl. ..... 418/201.3

(58) Field of Classification Search ..... 418/201.3, 418/150

See application file for complete search history.

(56) References Cited

U.S. PATENT DOCUMENTS

| | | | | |
|---|---|---|---|---|
| 2,622,787 | A * | 12/1952 | Nilsson | 418/201.3 |
| 4,890,991 | A * | 1/1990 | Yoshimura | 418/201.3 |
| 5,066,205 | A * | 11/1991 | Ingalls | 418/201.3 |
| 5,624,250 | A * | 4/1997 | Son | 418/150 |
| 5,674,063 | A * | 10/1997 | Ozaki et al. | 418/201.3 |
| 6,779,993 | B2 * | 8/2004 | Kim et al. | 418/201.3 |
| 2010/0086428 | A1 * | 4/2010 | Ju et al. | 418/201.3 |

FOREIGN PATENT DOCUMENTS

KR 0122515 B1 5/1997

* cited by examiner

*Primary Examiner* — Mary A Davis

(74) *Attorney, Agent, or Firm* — Nixon Peabody, LLP; Jeffrey L. Costellia

(57) ABSTRACT

A rotor profile for a screw compressor includes a male rotor and a female rotor, which are operated in an operation space while being engaged with each other, wherein a rotor profile of the female rotor includes a curve having an operation contact point located around a pitch circle at a following-side of the female rotor, the operation contact point being contacted with the male rotor to operate the male rotor when the female rotor is operated, and the curve is configured with a quadratic function $y=Lx^2+Mx+N$. Here, the constants L, M and N are values determined such that a slip ratio at the operation contact point is minimized. This rotor profile for a screw compressor minimizes a slip ratio at the operation contact point, thereby decreasing abrasion and reducing noise of the compressor.

10 Claims, 3 Drawing Sheets

ROTOR PROFILE FOR A SCREW COMPRESSOR

CROSS-REFERENCE TO RELATED APPLICATION

This application claims priority under 35 U.S.C. §119 the benefit of Korean Patent Application No. 10-2008-0097633, filed on Oct. 6, 2008, the entire contents of which are incorporated herein by reference.

BACKGROUND

1. Technical Field

Example embodiments disclosed herein relate to a rotor profile for a screw compressor.

2. Description of the Related Art

Generally, a screw compressor has a female rotor and a male rotor, which are operated in an operation space in a housing. If the female rotor and the male rotor are engaged with each other and rotated, a sealed volume in the housing is reduced by the rotors, and accordingly gas or air is compressed. The efficiency of the screw compressor is mainly dependent on processing precision and shape of the rotors. At present, many studies are under progress to improve a rotor profile which determines a geometric shape of the rotor.

Once, a rotor having a symmetric profile was used, but the rotor profile has changed into an asymmetric shape so as to minimize a leakage triangle and enhance insulation performance. So, curves configuring such a profile tend to be very complicated.

Factors giving bad influences on the efficiency of a screw compressor, caused by a geometric shape of the rotor profile, are increase of a gap between the rotor and the housing, increase of a gap between rotors in such as a vacuum-forming space, increase of volume of the leakage triangle, and so on.

In order to exclude such factors giving bad influences on the efficiency of a screw compressor as much as possible, there was an attempt to make the vacuum-forming space smaller and reduce a radius of a following-side of the female rotor such that a size of the leakage triangle is decreased. However, at this attempt, an actual tool of the rotor has a decreased pressure angle, so a machining error is increased during a machining process and also precise machining of the rotor becomes difficult. This problem results in deteriorated quality of the compressor.

Slip phenomenon occurring at a contact point by the geometric shape of the rotor profile when the rotors are operated is another factor to decrease the efficiency of a screw compressor. If a slip occurs at a contact point when the rotors are operated, the rotors scratch each other, which wears the rotors easily and increases noise of the compressor.

SUMMARY

In an effort to solve the above-described problems associated with the related art, provided is a rotor profile for a screw compressor, which may minimize a slip ratio at an operating contact point, minimize a size of a leakage triangle together with minimizing a slip ratio to increase the efficiency of a compressor, and ensure a tool pressure angle over a certain level.

In one aspect, there is provided a rotor profile for a screw compressor including a male rotor and a female rotor, which are operated in an operation space while being engaged with each other, wherein a rotor profile of the female rotor includes a curve having an operation contact point located around a pitch circle at a following-side of the female rotor, the operation contact point being contacted with the male rotor to operate the male rotor when the female rotor is operated, and wherein the curve is configured with a quadratic function $y=Lx^2+Mx+N$, where the constants L, M and N are values determined such that a slip ratio at the operation contact point is minimized.

In addition, the constants L, M and N may be values determined to minimize a slip ratio and a volume of a leakage triangle at the operation contact point.

According to the embodiments of the present invention, it is possible to decrease abrasion of the rotor and reduce noise of the compressor since a slip ratio at the operation contact point is minimized.

Further, since the rotor profile is formed according to optimal conditions allowing to minimize a size of the leakage triangle as well as minimizing the slip ratio at the operation contact point of the rotor, it is possible to enhance the efficiency of the compressor.

In addition, the profile is designed to minimize a vacuum-forming space, and a tool pressure angle is ensured over a certain level, so the efficiency of the rotor adopting the rotor is improved.

DETAILED DESCRIPTION

Figure 1:
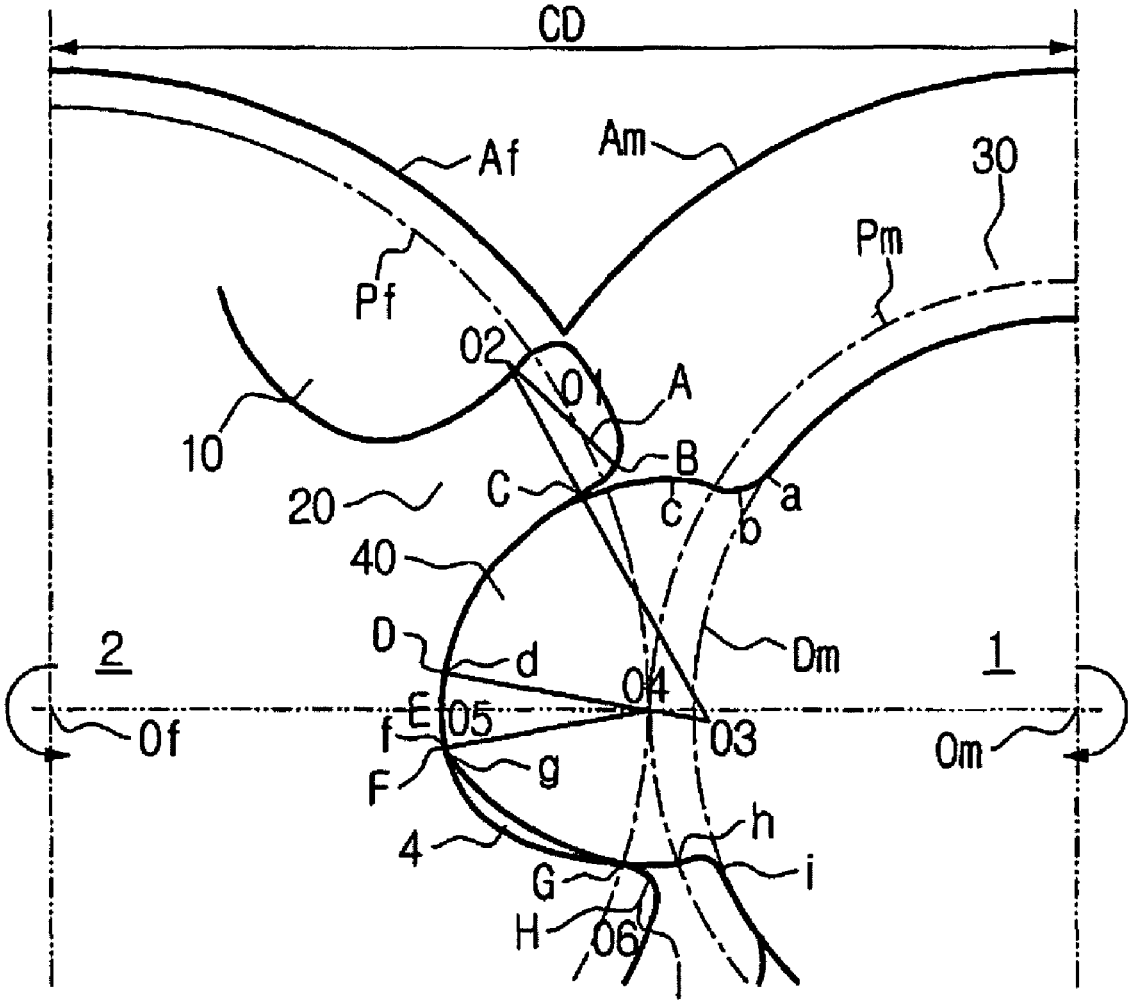
FIG. 1 is a sectional view showing an assembly of a male rotor 1 and a female rotor 2 according to one embodiment.

Hereinafter, example embodiments are explained with reference to the accompanying drawings. Though the present description is made based on the embodiments shown in the drawings, the embodiments are for illustration purposes only and are not limitative.

FIG. 1 is a sectional view showing an assembly of a male rotor 1 and a female rotor 2 according to one embodiment.

In FIG. 1, a symbol Om indicates a center of the male rotor 1, Of indicates a center of the female rotor 2, Am indicates an addendum circle of the male rotor 1, Af is an addendum circle of the female rotor 2, Pm is a pitch circle of the male rotor 1, Pf is a pitch circle of the female rotor 2, Dm is a dedendum circle of the male rotor 1, and CD is a distance between the centers Om and Of the male and female rotors 1, 2.

In this embodiment, the female rotor 2 has five lobes 20 and five spiral grooves 10 provided therebetween, and the male rotor 1 has four lobes 40 and four spiral grooves 30 provided therebetween. In FIG. 1, only a part of the plurality of lobes and spiral grooves is illustrated.

Referring to FIG. 1, the female rotor 2 and the male rotor 1 include a profile formed by eight curves, respectively.

The curve forming the profiles of the female rotor 2 and the male rotor 1 have the following characteristics. A first curve A-B of the female rotor 2 is an arc inscribed to an addendum circle Af of the female rotor 2 at a point A and inscribed to a second curve B-C of the female rotor 2 at a point B, and a center of the arc is a center O1. The second curve B-C of the female rotor 2 is an arc inscribed to the first curve A-B of the female rotor 2 at the point B and circumscribed to a third curve C-D of the female rotor 2 at a point C, and a center of the arc is a center O2. The third curve C-D of the female rotor 2 is circumscribed to the second curve B-C of the female rotor 2 at the point C and inscribed to a fourth curve D-F of the female rotor 2 at a point D, and a center of the arc is a center O3. The fourth curve D-F of the female rotor 2 is inscribed to the third curve C-D of the female rotor 2 at the point D and has a tangent line to a fifth curve F-G of the female rotor 2 at a point F, and a center of the arc is a center O4. The fifth curve F-G of the female rotor 2 is a generation curve generated by a fifth curve f-g of the male rotor 1. The fifth curve F-G of the female rotor 2 is generated based on the principle that, in a pair of gears having each centre of gravity with a predetermined center distance, if a profile curve of one of two gears (e.g., the fifth curve f-g of the male rotor 1) is determined, a profile of the other gear should have a common normal at a contact point.

A sixth curve G-H of the female rotor 2 is a curve having a common normal with the fifth curve F-G of the female rotor 2 at a point G. A seventh curve H-I of the female rotor 2 is an arc having a common normal with the sixth curve G-H of the female rotor 2 at a point H and inscribed to the addendum circle Af of the female rotor 2 at the point 1, and a center of the art is a center O6. An eighth curve I-A of the female rotor 2 is an arc coincided with the addendum circle Af of the female rotor.

A first curve a-b of the male rotor 1 is a generation curve generated by the first curve A-B of the female rotor 2. A second curve b-c of the male rotor 1 is a generation curve generated by the second curve B-C of the female rotor 2 and contacted with a third curve c-d of the male rotor 1 at a point c. The third curve c-d of the male rotor 1 is a generation curve generated by the third curve C-D of the female rotor 2 and connected to the second curve b-c of the male rotor 1. A fourth curve d-f of the male rotor 1 is a generation curve generated by the fourth curve D-F of the female rotor 2 and connected to the third curve c-d of the male rotor 1. A fifth curve f-g of the male rotor 1 is an arc contacted with the fourth curve d-f of the male rotor 1 at a point f, and a center of the arc is a center O5. A sixth curve g-h of the male rotor 1 is a generation curve generated by the sixth curve G-H of the female rotor 2 and connected to the fifth curve f-g of the male rotor 1.

A seventh curve h-i of the male rotor 1 is a generation curve generated by the seventh curve H-I of the female rotor 2 and having a common normal with the sixth curve g-h of the male rotor 1 at a point h. An eighth curve i-a of the male rotor 1 is an arc coincided with a dedendum circle Dm of the male rotor 1.

In this embodiment, the curve having the operation contact point contacted with the male rotor 1 to operate the male rotor 1 when the female rotor 2 is operated is the sixth curve G-H of the female rotor 2.

The sixth curve G-H positioned at a following-side of the female rotor 2 is located around a pitch circle Pf and contacted with the sixth curve g-h of the male rotor 1 at the operation contact point when the female rotor 2 is operated. If the sixth curve G-H positioned at the following-side of the female rotor 2 is designed with a wrong shape, the tooth surface may be seriously damaged since a slip ratio at the operation contact point is increased and abrasion of the rotor is increased.

Thus, in this embodiment, the sixth curve G-H positioned at the following-side of the female rotor 2 is configured with a quadratic function "$y=Lx^2+Mx+N$" so as to minimize a slip ratio at the operation contact point.

Figure 2:
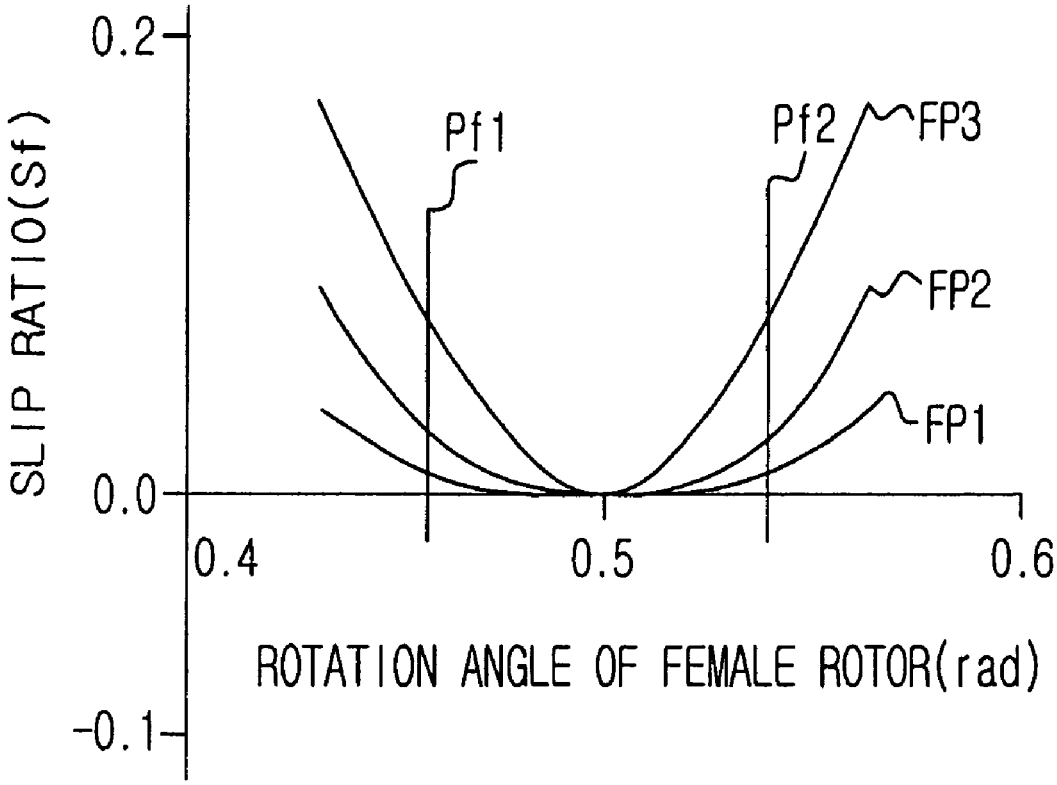
FIG. 2 is a graph showing a slip ratio at an operation portion of the female rotor 2 according to the change of coefficients L and M of a quadratic function ($y=Lx^2+Mx+N$) that configures a sixth curve G-H positioned at a following-side of the female rotor 2.

FIG. 2 is a graph showing a slip ratio at an operation portion of the female rotor 2 according to the change of coefficients L and M of the quadratic function "$y=Lx^2+Mx+N$" that configures the sixth curve G-H positioned at the following-side of the female rotor 2.

Figure 3:
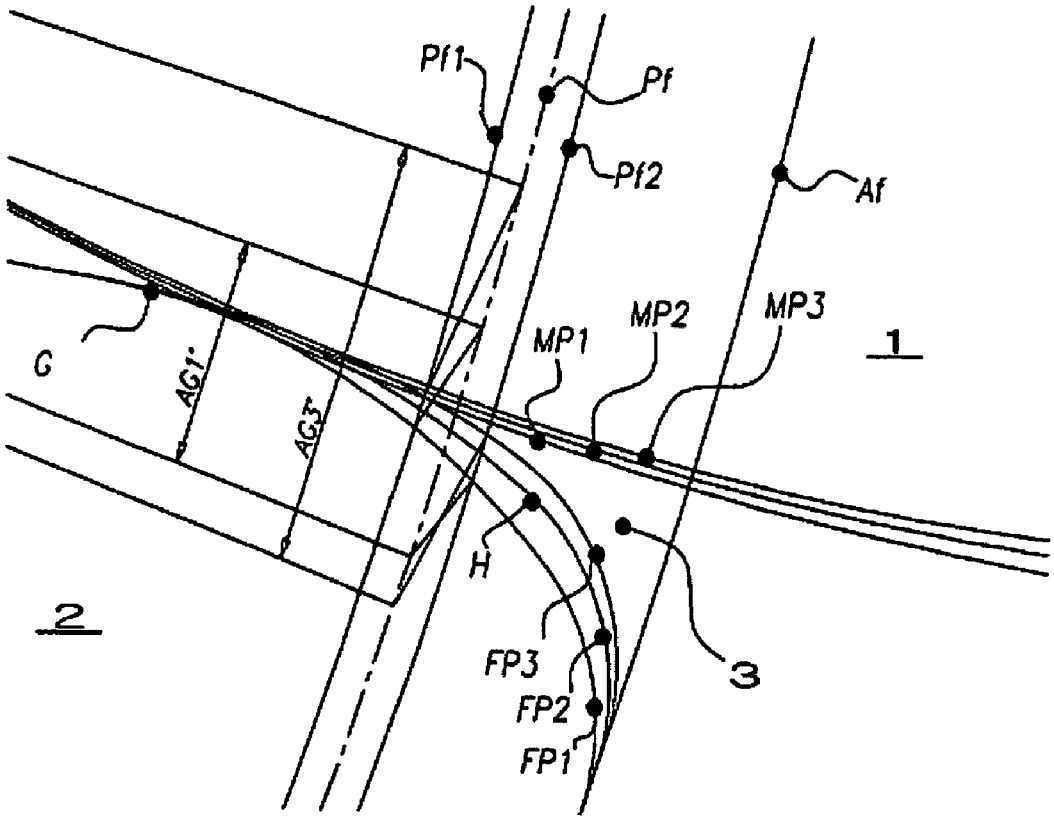
FIG. 3 is a schematic diagram showing the change of shape according to the change of the coefficients of the sixth curve G-H of the female rotor 2.

In FIG. 2, a symbol Pf1 indicates a circle positioned within 1% of a diameter of the pitch circle Pf of the female rotor 2, and Pf2 indicates a circle positioned out of 1% of the diameter of the pitch circle Pf of the female rotor 2 (see FIG. 3). Symbols FP1, FP2, FP3 indicate curves according to arbitrary values of constants L, M and N of the quadratic function "$y=Lx^2+Mx+N$" (see FIG. 3).

Referring to FIG. 2, it would be understood that a slip ratio Sf with respect to the same rotation angle of the female rotor 2 is changed as the constants L, M and N of the quadratic function "$y=Lx^2+Mx+N$" are changed. Thus, using this principle, it is possible to determine values of the constants L, M and N and then minimize the slip ratio Sf at the operation contact point of the sixth curve G-H of the female rotor 2 and the sixth curve g-h of the male rotor 1.

As mentioned above, if the curve G-H including the operation contact point, which is contacted to the male rotor 1 to operate the male rotor 1 when the female rotor 2 is operated, is formed using the quadratic function around the pitch circle Pf at the following-side of the female rotor 2 and its constants are adjusted to decrease the slip ratio, abrasion at the contact surface is decreased and overall vibration and noise of the compressor are improved.

In this embodiment, the constants L, M and N are adjusted such that the point G of the sixth curve G-H of the female rotor 2 starting from the point G is positioned within the pitch circle Pf of the female rotor 2, and more specifically the point G is positioned within 0.2 to 0.21% of the pitch diameter Df that is a diameter of the pitch circle Pf of the female rotor 2. If the point G is positioned as mentioned above, the female rotor 2 is contacted with the male rotor 1 at the pitch point when being operated, so a slip ratio Sf at the operation contact point between the sixth curve G-H of the female rotor 2 and the sixth curve g-h of the male rotor 1 is minimized such that the rotors may make a rolling movement with respect to each other.

As mentioned above, if the sixth curve G-H of the female rotor 2 is configured with the quadratic function "$y=Lx^2+Mx+N$" and the constants L, M and N are changed to minimize the slip ratio Sf, vibration and noise can be reduced. The radius of curvature of the sixth curve G-H of the female rotor 2 is increased, which means increase of the volume of a leakage triangle.

Thus, in another embodiment, a rotor profile may be formed to minimize a volume of a leakage triangle together with minimizing the slip ratio Sf.

FIG. 3 is a schematic diagram showing the change of shape according to the change of the coefficients of the sixth curve G-H of the female rotor 2.

In FIG. 3, a symbol Pf1 indicates a circle positioned within 1% of the diameter of the pitch circle Pf of the female rotor 2, and Pf2 indicates a circle positioned out of 1% of the diameter of the pitch circle Pf of the female rotor 2. Symbols FP1, FP2, FP3 indicate curves according to the change of constants L, M and N of the quadratic function "$y=Lx^2+Mx+N$". Symbols AG1, AG3 indicate an angle made by a normal of a point where the curves FP1, FP3 of the female rotor 2, which are quadratic function curves, meet each circle Pf1, Pf2 and an intersection point with the pitch circle Pf with respect to a center of gravity Of (see FIG. 1) of the female rotor 2. As the angles AG1, AG3 are greater, the slip ratio is increased. Since the angle AG3 is greater than the angle AG1, the curve FP3 has a greater slip ratio than the curve FP1.

Referring to FIG. 3, the slip ratio is smaller in the case that the sixth curve G-H of the female rotor 2 is formed with the curve FP1, rather than the case that the sixth curve G-H is formed with the curve FP3. However, it would be understood that a volume of the leakage triangle 3 is greater when the sixth curve G-H is formed with the curve FP1.

For enhancing the efficiency of the compressor, it is required to minimize the volume of the leakage triangle 3. Thus, when determining the constants L, M and N of the quadratic function "$y=Lx^2+Mx+N$" configuring the sixth curve G-H of the female rotor 2, an optimal condition is to minimize a volume of the leakage triangle in addition to minimizing the slip ratio Sf. Namely, when the sixth curve G-H of the female rotor 2 is the curve FP2, the slip ratio Sf is increased rather than the curve FP1, but the volume of the leakage triangle 3 is decreased. Energy efficiency of the compressor is increased as much as the volume of the leakage triangle 3 is reduced.

In one embodiment, the constant N may be set to 0, the constant M may be set to 1 and the constant L may be set to 4 to 6 for the convenience of calculation. According to the quadratic function with the above constant values, the leakage triangle 3 has a volume as much as 0.5% or less of an entire displacement volume.

In case the profile of the female rotor 2 is formed according to the above embodiment, noise and vibration of the compressor are decreased when the female rotor 2 is operated, which is more suitable for the operation of the female rotor 2. Thus, in still another embodiment, the profile of the female rotor 2 may be formed such that it is also suitable for operation of the male rotor 1.

Referring to FIG. 1 again, rolling contact can be made only when the operation contact point is positioned within the region of the second curve B-C of the female rotor 2 when the male rotor 1 is operated. Thus, in this embodiment, when the male rotor 1 is operated, the operation contact point is positioned within the region of the second curve B-C of the female rotor 2, and a radius of curvature of the second curve B-C of the female rotor 2 is determined to minimize a slip ratio at the contact point.

This embodiment may further increase the noise and vibration reducing effect of the compressor since the rotor profile suitable not only for the operation of the female rotor 2 but also for the operation of the male rotor 1 is obtained.

A vacuum-forming space 4 is one of factors causing noise and vibration of the compressor. A size of the vacuum-forming space 4 is determined depending on the included angle of the fourth curve D-F of the female rotor 2. Thus, the included angle of the fourth curve D-F of the female rotor 2 is minimized to decrease noise and vibration of the compressor.

Referring to FIG. 3 again, the seventh curve H-I of the female rotor 2 also gives an influence on the volume of the leakage triangle 3. In order to minimize the volume of the leakage triangle 3, it can be conceived to minimize a radius of the seventh curve H-I of the female rotor 2. However, if the radius of the seventh curve H-I of the female rotor 2 is too small, a tool pressure angle is decreased seriously, which may cause a problem in machining the female rotor 2.

In further another embodiment, in order to ensure a tool pressure angle over a certain level, the arc center 06 of the seventh curve H-I of the female rotor 2 is positioned at an outer side as much as 1.0203 to 1.0204 times of the pitch radius Pf of the female rotor 2, and the arc radius is 4.2 to 4.3% of the pitch radius Pf of the female rotor such that a tool pressure angle is 8 degrees or over.

Thus, this embodiment ensures a tool pressure angle over a predetermined level, which allows easy machining of the rotor profile and minimizes a machining error to ensure precise processing. As the rotor profile is machined precisely, the efficiency of the compressor is enhanced.

In order to improve the performance of the compressor, it is important to have a greater displacement capacity as possible while keeping the rotor as small as possible. An area index represents a relation between the displacement capacity and the size. In still another embodiment, the area index is set greater in consideration of the size of the addendum on the shape of the profile.

The size of the addendum of the female rotor 2 is generated due to the difference between the radius of the outer circle Af and the radius of the pitch circle Pf. Thus, in this embodiment, the size of the addendum is set to 6 to 6.2% of the radius of the pitch circle Pf. In this size of the addendum, the area index becomes 0.465, so it is possible to give a rotor profile with a great displacement capacity while ensuring a small size of the rotor.

In addition, in this embodiment, a minimum tooth thickness of the female rotor 2 is set to 11% or more of the pitch radius Pf of the female rotor 2 through the calculation of strength such that the tooth thickness of the female rotor 2 is not be decreased too much according to the addendum size. It allows the rotor not to be weakened seriously.

What is claimed is:

1. A rotor profile for a screw compressor including a male rotor and a female rotor, which are operated in an operation space while being engaged with each other, wherein a rotor profile of the female rotor includes a curve having an operation contact point located around a pitch circle at a following-side of the female rotor, the operation contact point being contacted with the male rotor to operate the male rotor when the female rotor is operated, and wherein the curve is configured with a quadratic function $y=Lx^2+Mx+N$, where the constants L, M and N are values determined such that a slip ratio and a volume of a leakage triangle at the operation contact point are minimized.

2. The rotor profile for a screw compressor according to claim 1, wherein the female rotor has five lobes and five spiral grooves provided therebetween, and the male rotor has four lobes and four spiral grooves provided therebetween.

3. The rotor profile for a screw compressor according to claim 1, wherein the quadratic function $y=Lx^2+Mx+N$ starts at a point where the curve starts, the point where the curve starts is positioned in the pitch circle of the female rotor, and the point is within 0.2 to 0.21% of a pitch diameter of the pitch circle of the female rotor.

4. The rotor profile for a screw compressor according to claim 1, wherein the constant N is 0, the constant M is 1 and the constant L is 4 to 6 such that the leakage triangle has a volume as much as 0.5% or less of an entire displacement volume.

5. The rotor profile for a screw compressor according to claim 1, wherein the profile of the female rotor has a curve A-B, a curve B-C, a curve C-D, a curve D-F, a curve F-G and a curve G-H, wherein the profile of the male rotor has a curve a-b, a curve b-c, a curve c-d, a curve d-f, a curve f-g and a curve g-h, wherein the curve A-B of the female rotor is an arc inscribed to an addendum circle of the female rotor at a point A and inscribed to the curve B-C of the female rotor at a point B, wherein the curve B-C of the female rotor is an arc inscribed to the curve A-B of the female rotor at the point B and circumscribed to the curve C-D of the female rotor at a point C, wherein the curve C-D of the female rotor is circumscribed to the curve B-C of the female rotor at the point C and inscribed to the curve D-F of the female rotor at a point D, wherein the curve D-F of the female rotor is circumscribed to the curve C-D of the female rotor at the point D and has a tangent line to the curve F-G of the female rotor at a point F, wherein the curve F-G of the female rotor is a generation curve generated by the curve f-g of the male rotor, wherein the curve G-H of the female rotor is a curve having a common normal with the curve F-G of the female rotor at a point G, wherein the curve a-b of the male rotor is generation curve generated by the curve A-B of the female rotor, wherein the curve b-c of the male rotor is a generation curve generated by the curve B-C of the female rotor and contacted with the curve c-d of the male rotor at a point c, wherein the curve c-d of the male rotor is a generation curve generated by the curve C-D of the female rotor and contacted with the curve b-c of the male rotor, wherein the curve d-f of the male rotor is a generation curve generated by the curve D-F of the female rotor and contacted with the curve c-d of the male rotor, wherein the curve f-g of the male rotor is an arc contacted to the curve d-f of the male rotor at a point f, wherein the curve g-h of the male rotor is a generation curve generated by the curve G-H of the female rotor and connected to the curve f-g of the male rotor, and wherein the curve having an operation contact point located around a pitch circle at a following-side of the female rotor is the curve G-H of the female rotor.

6. The rotor profile for a screw compressor according to claim 5, wherein, when the male rotor is operated, the operation contact point is positioned in the curve B-C region of the female rotor, and wherein the curve B-C of the female rotor has a radius of curvature determined to minimize a slip ratio at a contact point.

7. The rotor profile for a screw compressor according to claim 5, wherein an included angle of the curve D-F of the female rotor is set to be minimized.

8. The rotor profile for a screw compressor according to claim 5, wherein the profile of the female rotor further includes a curve H-I and a curve I-A, and the profile of the male rotor further includes a curve h-i and a curve i-a, wherein the curve H-I of the female rotor is an arc having a common normal with the curve G-H of the female rotor at a point H and inscribed to the addendum circle (Af) of the female rotor at a point I, wherein the curve I-A of the female rotor is an arc coincided with the addendum circle (Af) of the female rotor, wherein the curve h-i of the male rotor is a generation curve generated by the curve H-I of the female rotor and having a common normal with the curve g-h of the male rotor at a point h, wherein the curve i-a of the male rotor is an arc coincided with a dedendum circle (Dm) of the male rotor, and wherein a center of the arc of the curve H-I of the female rotor is positioned at an outer side as much as 1.0203 to 1.0204 times of a pitch radius (Pf) of the female rotor, and a radius of the arc is 4.2 to 4.3% of the pitch radius (Pf) of the female rotor.

9. The rotor profile for a screw compressor according to claim 1, wherein the female rotor has an addendum whose size is 6 to 6.2% of the pitch radius (Pf) of the female rotor.

10. The rotor profile for a screw compressor according to claim 9, wherein a minimum tooth thickness of the female rotor is 11% or more of the pitch radius (Pf) of the female rotor.

* * * * *